United States Patent [19]

Bacher et al.

[11] Patent Number: 4,967,168

[45] Date of Patent: Oct. 30, 1990

[54] COAXIAL-WAVE GUIDE COUPLING ASSEMBLAGES

[75] Inventors: Edward V. Bacher, Berkeley Heights; Robert E. Myer, Denville, both of N.J.

[73] Assignee: AT&T Bell Laboratories, Murray Hill, N.J.

[21] Appl. No.: 401,364

[22] Filed: Aug. 31, 1989

[51] Int. Cl.[5] ..... H01P 1/04; H01P 5/103

[52] U.S. Cl. ..... 333/26; 333/125; 333/33; 333/260; 439/578; 439/825

[58] Field of Search ..... 333/125, 137, 245, 260, 333/26, 33; 439/578, 581, 825

[56] References Cited

U.S. PATENT DOCUMENTS

| | | | |
|---|---|---|---|
| 2,225,728 | 12/1940 | Weidenman, Sr. | 439/578 X |
| 2,332,529 | 10/1943 | Reppert | 439/578 X |
| 3,258,735 | 6/1966 | Valle | 439/581 |
| 3,275,970 | 9/1966 | Johanson et al. | 439/578 |
| 3,539,966 | 11/1970 | Logan | 333/260 X |
| 4,396,242 | 8/1983 | Kurano et al. | 439/581 |
| 4,724,400 | 2/1988 | Luettgenau | 330/295 |

*Primary Examiner*—Paul Gensler
*Attorney, Agent, or Firm*—Ruloff F. Kip

[57] ABSTRACT

Coaxial units are disclosed for coupling an r.f. amplifying microstrip to splitter and combiner wave guides, respectively, of a splitter-combiner apparatus. Each coaxial unit comprises an outer conductor sleeve and an inner conductor pin projecting forward of the sleeve, both the sleeve and pin having forward portions which are resiliently compressible radially inward, and the sleeve being radially enlarged at its front end. The coaxial unit is coupled at its front to its associated wave guide by having its sleeve and pin forward portions, respectively, received in, and radially inwardly compressed in, large and small bores respectively formed in the metallic plates on opposite sides of the dielectric chamber of the associated wave guide. Those forward portions make direct yieldable-pressure electrical contacts with metallic walls of these bores at locations adjacent to the openings of such bores into that chamber. Each coaxial unit has a terminal post projecting from its sleeve away from its pin, and each such unit is secured to the structure of the associated amplifier by being bolted thereto, with part of the body of the unit being received in an end recess in the amplifier structure, and with the unit's terminal post being soldered to a printed conductor of the amplifier.

6 Claims, 3 Drawing Sheets

COAXIAL-WAVE GUIDE COUPLING ASSEMBLAGES

TECHNICAL FIELD

This invention relates generally to assemblages for coupling spaced locations at which are manifested high frequency electromagnetic energy to permit communication of such energy between such locations. More particularly, this invention relates to assemblages of such kind constituting, for example without restriction, combinations of coaxial guide means and wave guide means, combinations of coaxial guide means and r.f. signal processing means and coaxial coupling units adapted for r.f. coupling of such spaced locations with each other.

BACKGROUND OF THE INVENTION

On Feb. 9, 1988, U.S. Pat. No. 4,724,400, entitled "Linear Amplifier" was issued in the name of G. G. Luettgenau to TRW Inc. (the "400 patent"). Such patent is treated herein solely as a publication. The disclosure of the '400 patent as a publication is, however incorporated herein by reference and made a part hereof.

The '400 patent shows and describes a microwave splitter-combiner apparatus comprising a cylindrical stack of vertically superposed circular metallic plates defining within the stack an upper splitter waveguide and a lower combiner waveguide. Each such waveguide comprises a pair of vertically spaced metallic walls and a chamber between and bounded by such walls and providing a passage through which microwaves propagate, the chamber being essentially in the form of a horizontal cylindrical disk. In the splitter wave guide, the microwaves travel through its cylindrical disk chamber from its center radially outward while, in the combiner waveguide, such travel in its chamber is radially inward towards the center of the chamber.

Disposed on a plate member providing a top closure for the mentioned stack is a set of twenty r.f. amplifier operating units each essentially in the shape of a rectangular block. The twenty units are equiangularly spaced in carousel fashion around the top of such member in respective radial planes which are vertical and pass through the vertical axis of the stack.

Each of such twenty r.f. amplifier units is coupled to the splitter wave guide by an input coaxial connector and to the combiner waveguide by an output coaxial connector. In the operation of the apparatus, high frequency electromagnetic energy is fed to the splitter waveguide's center, travels therefrom radially outward through the waveguide's chamber to the twenty input connectors and is then fed upward by them to the twenty amplifiers which operate in parallel to amplify such energy. The amplified energy is then fed via the twenty output connectors to points in the combiner waveguide's chamber which are radially outward of the chamber's center. From those points the energy travels as waves radially inward through the chamber to its center to there be combined and provide an amplified output from the apparatus.

The '400 patent describes the mentioned connectors as each being a semi-rigid coaxial line or lead comprising a hollow cylindrical outer conductor, a center cylindrical conductor coaxial therewithin, and a cylindrical filling or sleeve of dielectric material, the center conductor being greater in length than the outer conductor to provide a tip which extends beyond the front of the outer conductor. In use, each connector is coupled to its associated waveguide by being received (FIGS. 5*a* and 9) in vertical holes formed in the plates bounding the top and bottom of the waveguide chamber such that the outer and inner conductors make electrical contact with the walls of the holes in, respectively, the upper and lower plates of the waveguide. No further material details are given in the '400 patent regarding the connection of such connectors to their respective wave guides or the manner of their fastening to their associated r.f. amplifiers.

The coaxial connectors described in the '400 patent have the disadvantage in their use in the disclosed splitter-combiner apparatus that, because the inner and outer conductors of such connectors have outer surfaces which are essentially unyielding and are wholly circular cylindrical, and uniform in cross section, it is often difficult to produce a firm, durable and/or reliable electrical contact between such conductors and the walls of the holes in the wave guide plates in which such conductors are received. As another disadvantage, if, it is attempted to improve such electrical contact, by providing a very close or precision fit of the conductors of the connecting in such holes, then, when it is sought to lift the amplifier associated with the connector vertically up and away from the rest of the splitter-combiner in order to, say, perform some act on the amplifier, the fit between the connector conductors and their receptable holes in the wave guide plates may be so tight as to bind the connector conductors in such holes and thereby cause detachment of the connector from the amplifier. If, however, such detachment occurs, the detached connector produces a short circuit a.c. impedance in the wave guide to which it remains connected.

SUMMARY OF THE INVENTION

The foregoing disadvantages are overcome according to the invention in one of its aspects by providing a coaxial coupling unit comprising concentric radially spaced outer and inner conductors having respective cylindrical outer surfaces, and dielectric material between such conductors, the i nner conductor extending beyond the front end of the outer conductor to provide a stiff contact pin projecting forward of such end, and in which forward portions of the outer conductor and of the pin are made so that such forward portions are resiliently compressible radially inward.

According to the invention in another of its aspects, the problem of inadvertent detachment of the coaxial coupling unit from its associated r.f. amplifier is reduced or avoided by fabricating the rear end of the unit to permit bolting thereof to the amplifier while concurrently permitting appropriate electrical connections to be made from the amplifier to the inner and outer conductors of the unit.

BRIEF DESCRIPTION OF THE DRAWING

For a better understanding of the invention, reference is made to the following description of an exemplary embodiment thereof and to the accompanying drawings wherein.

DETAILED DESCRIPTION

Figure 1:
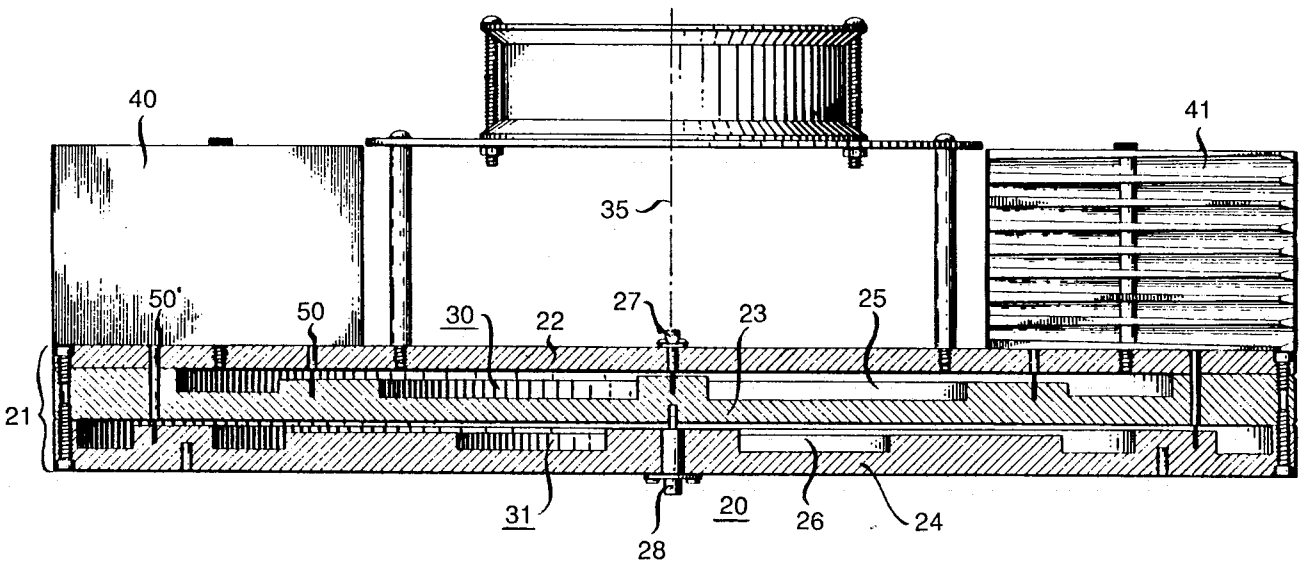
FIG. 1 is front elevational cross-sectional schematic view of a splitter-combiner apparatus incorporating coaxial coupling units according to the invention and other assemblages according thereto.

Referring now to FIG. 1, the reference numeral 20 designates a splitter-combiner and amplifying apparatus comprising a circular cylindrical vertical stack 21 of superposed, circular, aluminum horizontally-disposed plate members all at d.c. ground and constituting an upper member 22, a middle member 23 and a lower member 24. While the bottom of member 22 is planar, the confronting top of member 23 is selectively inwardly recessed as shown to define between the members a chamber 25 containing a dielectric material (e.g. air) and in the form of a cylindrical disk. The chamber 25 is bounded on its vertically opposite sides and around its periphery by two metallic wall means provided by the portions adjacent to the chamber of members 22, 23, and such metallic wall means, together with chamber 25, constitute an upper splitter wave guide 30 adapted to receive high frequency electromagnetic energy via a coaxial input terminal 27 at the wave guide's radial center. Similarly, there is defined between the members 23 and 24 a cylindrical disk chamber 26 which is bounded by two metallic wall means provided by portions of such members, and which chamber, together with the latter two wall means, constitutes a lower combiner wave guide 31 adapted to provide an output of high frequency electromagnetic energy via an output coaxial-terminal 28 at the radial center of the combiner wave guide.

Upper member 22 supports on its top a ring of twenty r.f. amplifier modules equiangularly spaced around that member. Each such module comprises a housing and, within that housing, the amplifier's operating unit which has the overall structure of a thin rectangular block and will, hence be referred to as such. FIG. 1 shows, in respect of the amplifier modules mounted on stack 21, only the amplifier block 40 of the most leftward amplifier module and the housing 41 of the most rightward amplifier module. Block 40 is, like the blocks of the nineteen other amplifier modules, disposed in relation to the stack 21 on which it is mounted to lie in a plane which contains the vertical axis 35 of the stack and is, thus, a radial plane. Therefor block 40 projects upward from stack 21 like a fin.

Amplifier block 40 comprises (FIGS. 2 and 3) a relatively thick aluminum support plate 42 providing support and a backing and a heat sink for a microstrip 43. Microstrip 43 comprises (a) a thin insulative sheet 44 bonded at its back to plate 42, and (b), on the front of the sheet, various discrete electric circuit components, including these designated 45, 46, and various printed conductors on the sheets surface, including these designated 47, 48. The electric circuit components and conductors on the sheet are interconnected to form circuitry which is operable as an r.f. amplifier. The microstrip 43 resembles in appearance a conventional printed wiring board but, because of the high frequencies at which its circuitry operates, the spacing of the components and conductors of the microstrip is critical.

The amplifier block 40 is supplied from splitter wave guide 30 with high frequency electrical energy at 860–900 MHz via an input coaxial coupling unit 50, and such block in turn provides a supply of such energy as amplified to the combiner wave guide 31 via an output coaxial coupling unit 50'. Those two coupling units will now be considered.

Referring to FIGS. 4–7, the coupler 50 comprises a tubular outer conductor 55, an inner conductor 56 passing through and radially spaced inward of conductor 55, and a body 57 of dielectric material (e.g. TEFLON®) interposed between the two conductors and maintaining them in fixed spaced relation in which they are concentric and coaxial about a common axis 58.

Dielectric body 57 is wholly contained within outer conductor 55. The body has a rear section 51 and a forward section 52. Rear section 51 is cylindrical in form and is in full contact over its whole axial extent with the conductors 55, 56. Forward section 52 is frustro-conical in form and has a forwardly converging taper so that the exterior of that section progressively recedes from the interior surface of conductor 55 with increasing distance away from the body's rear section 51.

Outer conductor 55 is in the form of a tubular sleeve of a resilent electroconductive metallic material such as phosphor-bronze. The sleeve 55 has interior and exterior surfaces which are circular cylindrical except at the sleeve's front end where there is a departure from circular cylindrical form as later described. At that front end there is formed in the sleeve six slots 58 equiangularly spaced around it and extending radially through the sleeve and axially from the sleeve's front end backwards (by the same distance for all slots) to rear terminations of such slots. The slots 58 thus divide a forward portion 61 of the sleeve (extending from its front end to the rear terminations of the slots) into six axially-extending circumferentially arcuate fingers 60. Because each of such fingers 60 is separated by slots 58 on either side thereof from the fingers adjacent thereto, and because of the taper of section 52 of the dielectric body, each such finger has room to move radially inwards, and, in so doing to close towards its adjacent fingers. Hence, all of fingers 60 may be concurrently resiliently deflected radially inward such that the forward portion 59 of the sleeve is, as a whole, resiliently compressible radially inward.

Another feature at the front end of sleeve 55 is that its front edge is rolled over to form an annular bead 65 extending around the sleeve discontinuously (because interrupted in six places by the slots 60) to form at the sleeve front a radial enlargement. That is, at bead 65, the sleeve has a greater outer diameter than it has at locations to the rear of the bead.

At its rear end, the outer conductor has a pair of flanges 66 lying in a diametrical plane of the outer conductor and united to the outside of the sleeve 55 and projecting in opposite directions radially therefrom. The flanges 66 have bolt holes 67 passing therethrough.

The thickness of each of the flanges is equal to or slightly greater than the diameter of the inner conductor 56 of the coupler 50.

Turning now to the inner conductor 56, it is an axially elongated relatively stiff solid rodlike member constituted like conductor 55 of a resilient electroconductive metallic material such as phosphor-bronze. Conductor 56 has a middle section 70 contained within sleeve 55, a section 71 to the rear of the sleeve and constituting a terminal post, and a section 75 projecting forward of the sleeve and taking the form of a circular cylindrical contact pin. Pin 75 has at its front a tip 76 convergently tapered in the forward direction. The pin has formed in its tip 76 and rearward thereof two diametrical slots 77, 78 normal to each other and extending from the front end of the tip axially backward through and beyond the tip to an intermediate location in the length of the pin at which the slots have rear terminations. The slots 77,78 divide a forward portion 79 of the pin 75 (extending from such location to the front of the tip) into four axially-extending fingers 80 having cross-sections in the form of cylindrical sectors. All of such fingers 80 are concurrently resiliently deflectable radially inward so that forward portion 79 is as a whole resiliently compressible radially inward.

The output coaxial coupling unit 50' is the same in structure as the input unit 50 with the one exception that the sleeve 55' of unit 55' is substantially longer than the sleeve 55 of unit 50. Both units have a 50 ohm a.c. impedance in relation to the wave energy processed by the FIG. 1 apparatus.

Figure 2:
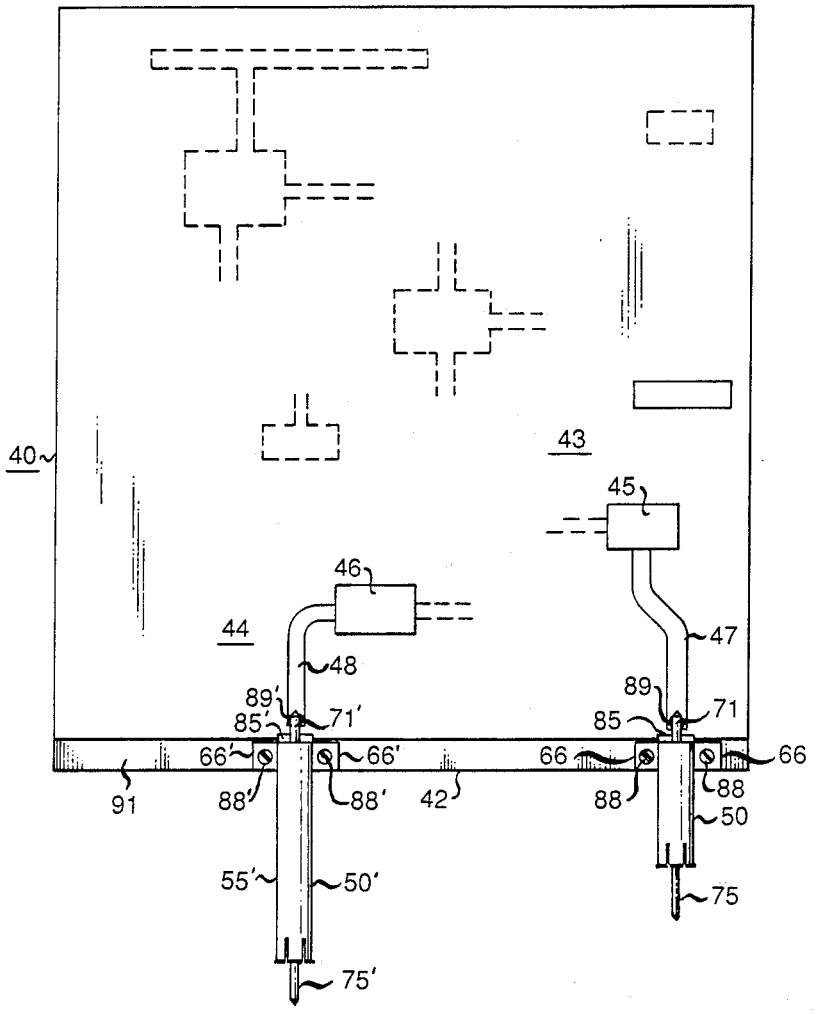
FIG. 2 is a front-elevational schematic view of an assemblage comprising one of the amplifier units of FIG. 1 and input and output coaxial coupling units fastened to that amplifier unit.
Figure 3:
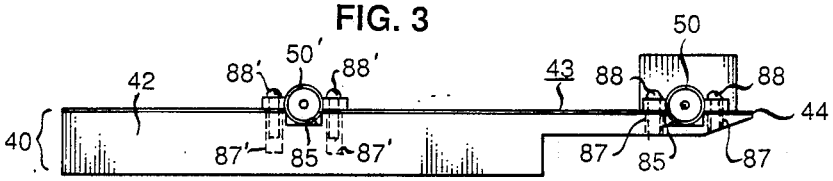
FIG. 3 is a bottom schematic view of the FIG. 2 assemblage.
Figure 7:
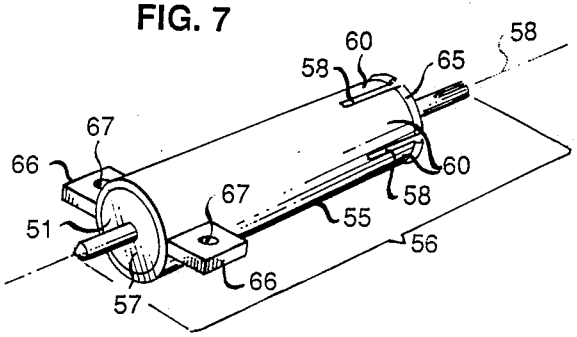
FIG. 7 is an isometric view of the FIG. 4 coaxial coupling unit.
Figure 4:
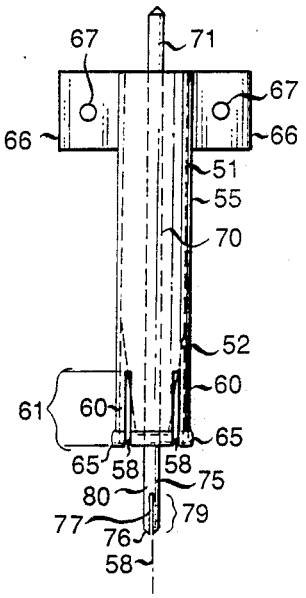
FIG. 4 is an enlarged front elevational view of the input coaxial coupling unit of FIG. 1.

Referring now back to FIGS. 2 and 3, the coaxial couplers 50 and 50' are united with the amplifier block 40 as follows. Block 40 has secured therein at its bottom end (FIG. 2) and at its front side (i.e., the side seen face as in FIG. 2) a pair of recesses 85, 85' spaced from each other along the block's bottom and extending upwardly therefrom for a short distance into the support plate 42 and the insulative board 44 of the microstrip 43. Such recesses 85, 85' are open at the top of block 40, are of rectangular "U" cross-section and are open also on the front side of the block. The two recesses 85, 85' are associated with respective pairs of holes formed in microstrip 43 and of threaded bolt holes 87, 87' in support plate 42 of which the holes in each pair are disposed on opposite sides of the corresponding recess. Such pairs of threaded holes match the pairs of threaded holes 67, 67' formed in the metallic flanges 66, 66' of the couplers 50, 50'.

To fasten those couplers to the block 40, the couplers are placed against the front of the block so that the holes 67, 67' in the flanges 66, 66' of the couplers 50, 50' register with the holes 87, 87' in the block under circumstances in which the couplers are in position relative to board 40 in which they extend downwards from the block. In such positions, the couplers 50, 50' straddle the front side openings of recesses 85, 85'. Slightly less than half of the bodies of such couplers are received in such recesses, and the terminal posts 71, 71' of the couplers respectively overlie the conductive paths 47,48 on board 44 to either contact those paths or be very close to them. This occurs because the bottoms of the flanges 66 and 66' lie in planes to which the adjacent surfaces of the associated posts 71, 71' are substantially tangential.

Once so placed, the couplers are fastened in such positions to block 40 by inserting threaded metallic bolts 88, 88' through the bolt holes 67, 67' in the couplers' flanges and then through the holes (not shown) in microstrip 43 and into the threaded holes 87, 87' in block 40, and by subsequently tightening those bolts enough to attach the couplers 50, 50' firmly and fixedly to block 40. With the couplers thus being mechanically joined to the block inadvertent detachment of the couplers from the block is unlikely.

Permanent electrical contacts are then established between the terminal posts 71, 71' and the conductive paths 47, 48 by supplying solder masses 89, 89' to the junctions or near-junctions of those posts and paths and by treating such masses to form solder joints between the posts and paths. Such masses in the solder joints are preferably in the form of thin rectangular fillets of solder on not much greater width than the terminal posts 71, 71' and interposed in contact with those posts on the conductive paths 47, 48. The bolts 88 and 88' and flanges 66, 66' perform the electrical function of maintaining the outer conductors of the couplers 50, 50' at d.c. ground by providing low impedance paths from those conductors through the bolts and the flanges 66, 66' to a copper clad ground plane 91 constituting a printed area on top of sheet 44 and contacted by the bottoms of flanges 66, 66' and to, moreover, support plate 42 which is kept at d.c. ground. The elements 42 and 91 serve as ground terminals for the r.f. amplifier 43 while the bottom ends of printed conductors 47, 48 serve as "high" terminals therefor.

Figure 5:
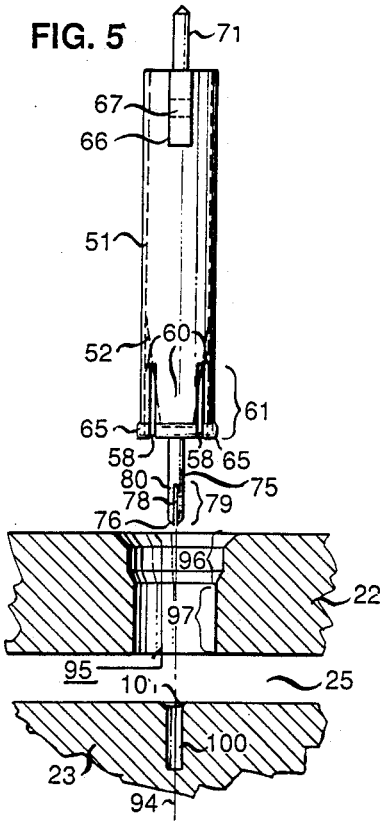
FIG. 5 is a side elevation of the FIG. 4 coupling unit and a fragmentary cross-sectional view of a portion of one of the wave guides of the FIG. 1 apparatus, the coupling unit being shown in FIG. 5 as positioned for insertion into that wave guide portion.

The lower part of coupler 50 is electromechanically connected to the splitter wave guide 30 as follows. Referring to FIG. 5, the plate member 22 (providing the upper metallic wall means bounding chamber 25 of the wave guide) has formed therein a vertical bore 95 having an axis 94 and passing all the way through plate 22. Bore 95 ha a flared upper section 96 facilitating entry into the bore of the coupler 50. Upper section 96 tapers into a lower bore section 97 which is circular cylindrical. Bore section 97 has a diameter which is smaller than the outer diameter of the bead 65 on the coupler, and which is greater than the outer diameter of outside circular cylindrical surface of the sleeve 55 rearward of that bead by just enough to provide a clearance or slip fit between that cylindrical surface and the interior wall of bore section 97. The cylindrical section 97 of bore 95 terminates downward in an opening 98 (FIG. 6) thereof into chamber 25.

Directly below bore 95 there is formed in the plate member 23 (providing the lower metallic wall means bounding chamber 25) a smaller bore 100 coaxial with bore 95 about axis 94. Bore 100 has a slightly flared mouth 101 at an opening of such bore into chamber 25, and the bore extends from that opening downward into plate 23 but does not pass all the way through the plate. Bore 100 is circular cylindrical in form and has a diameter slightly smaller than the diameter of the forward portion 79 of pin 75 of the coupler 50 when that forward portion is resiliently unstressed.

Figure 6:
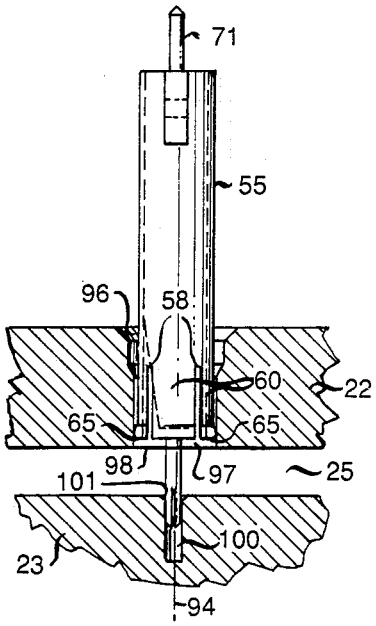
FIG. 6 is a side elevation of the coupling unit and wave guide portion shown in FIG. 5 when such unit is inserted into such portion.

The spaced metal plates 22, 23 and the bores 95, 100 therein provide a receptacle adapted to have seated therein the lower part of coupler 50. FIG. 6 depicts the coupler as so seated. As shown in that figure, the tip 76 (FIG. 5) of pin 75 of the coupler and part of the pin to the rear of that tip is inserted into small bore 100 to extend from the bores top opening 101 down into the bore. Because the bore's diameter is less than the normal diameter of the forward portion 79 of the pin, as the pin is being inserted into the bore, the edge of the bore's top opening 101 exerts radially inward force against the fingers 80 in forward portion 79 of the pin to cause resilient deflection radially inward of all such fingers and consequent resilient compression radially inward of the pin forward portion 79 as a whole. The result of such compression is that pin 75 presses with yieldable pressure force against the metallic regions on the interior wall surface of bore 100 to make direct electromechanical contact with those regions and thus with plate 23. Since such contact is a yieldable pressure contact produced by forcible fitting of a leading part of pin portion 79 into the smaller diameter bore 100, the contact is firm, durable and reliable. The location of the contact between the coupler pin 75 and the plate 23 is at or otherwise adjacent to the opening 101 of the bore 100 of the plate into the wave guide chamber 25. It has been found that such location for such contact is desirable (and is especially preferred when exactly at such opening) because such location reduces or eliminates the creation of an a.c. impedance mismatch at the point of coupling of coaxial unit 50 to the splitter waveguide.

Because, however, the bore 100 has a smaller diameter than does pin 75 at the junction of its forward portion 79 with the rest of the pin (i.e., such junction being at the point in the length of the pin at which are the rear terminations at the slots 77 and 79), it is not possible to force all of such forward portion into the bore 100. That is, while the fingers 80 in such forward portion may, with greater downward insertion force on the pin, be deflected from their bases at such junction radially inward more and more to produce an increasing convergent taper for portion 79 and greater insertion of pin 75 into bore 100, a point is reached at which such fingers cannot be so deflected any further. In consequence, there is a limit as to how far the contact pin of the coupler unit 50 can be inserted into the bore 100.

In contrast, no such limit as a function of bore diameter is set for the sleeve 55 of the coupler which can be inserted into the upper large bore 95 as far as the length of the sleeve will permit.

More specifically as, in the course of such insertion, the front end of the sleeve starts to enter the lower cylindrical section 97 of the bore, the bead 65 makes certain contact with the interior wall of that section because the outer diameter of the bead is then greater than that of the bore. Moreover, and because of that difference in diameter, as the sleeve continues to move down in the bore, such contact produces a resilient deflection radially inward of the fingers 60 in the forward portion 61 of the sleeve and a consequent resilient compression radially inward of that portion as a whole, with the bead 65 remaining in contact with the metallic interior wall of the bore section 97. The resilient compression causes the various arcuate segments of bead 65 to press with reactive yieldable force against the bore wall so as to provide between the sleeve and such metallic wall a direct electromechanical contact which is a yieldable pressure contact and is firm, reliable and durable like the contact made in the lower bore 100. As shown in FIG. 6, such contact between the sleeve bead 65 and the bore is made at a position adjacent to the opening 98 of the bore 95 into the wave guide chamber 25. As earlier stated, such positioning of such contact adjacent to such opening is desirable because it reduces or eliminates a.c. impedance mismatch which would result in the wave guide if such contact were located elsewhere. Optimum results are usually obtained when such contact is directly at such opening. To generalize on the foregoing, we have found, in the instance of connections of coaxial coupling units to a wave guide as described, that the conductors (outer and inner) of the coaxial unit preferably should make respective electrical contacts with the two metallic wall means on opposite sides of the wave guide chamber at or otherwise adjacent to the opposite, boundary surfaces defined for such chamber by those two wall means, in order thereby to reduce or remove a.c. impedance mismatch at the point of coupling between the wave guide and the coaxial unit.

The sleeve 55 behind the bead 65 is smaller in diameter by a clearance fit than the smallest diameter of the bore 95 in which the sleeve is received. Accordingly there is no limit set by bore diameter on how far the sleeve can be inserted into the bore.

Coaxial unit 50' is coupled to combiner wave guide 31 by having its sleeve 55' and pin 75' make electrical contacts, (the same in character as those described above for sleeve 55 and pin 75), with the interior surfaces of, respectively, large and small bores formed in, respectively, the plates 23 and 24 and structurally the same as the bores 95 and 100 recently described. In order for sleeve 55' to reach plate 23, the sleeve passes downward with a clearance fit through a vertical bore made for that purpose in plate member 22.

The operation of the FIG. 1 appaaratus will be apparent from the description already given. Briefly, high frequency electromagnetic wave energy is supplied via terminal 27 to splitter wave guide 30 to be distributed within it to the twenty input coaxial coupling units for the twenty amplifiers of the apparatus. The fraction of that energy distributed to coupling unit 50 is transmitted by it to r.f. amplifier unit 43 within which the energy is amplified. That amplified energy is subsequently piped by coaxial unit 50' to combiner wave guide 31 in which it is combined with the energy from the other r.f. amplifiers, and the combined energy is then tapped from that wave guide at its ouptput terminal 28.

The mode of electrical contact between pin 75 of coupler 50 and the interior wall of bore 100 in plate 23 can be made to resemble the contact between sleeve 55 and the interior wall of bore 95 by effecting the following modifications. First, the diameter of bore 100 is enlarged to make it greater by at least a clearance fit than the diameter of pin 75 rearward of its forward section 79. Second, there is inserted into the slots 77 and 78 in that section 79 a tool (which may resemble a star drill) which wedges the fingers 80 of that section apart so that the free ends of those fingers are radially deflected outwards from the axis 58 of the pin. Third, with the wedging tool still in those slots to hold those fingers so deflected, radially inward directed forces are applied to pin section 79 rearward of the tool but forward of the rear terminations of slots 77, 78 to produce a crimping effect which inelastically deforms the pin material so that fingers 80 will remain splayed outward after the wedging tool is removed. In this way there will be formed at the front end of pin 75 a radial enlargement which will function in the increased diameter bore 100 in the same as bead 65 on sleeve 55 functions in cylindrical section 97 of bore 95. When, however, such radial enlargement is imparted to the front of pin 75, the pin is adapted to make good electrical contact at that radial enlargement with the bore wall and, at the same time, not be limited by bore diameter as to the depth to which the pin can be inserted in the bore.

It will be noted that amplifier block 40, a housing therefor (like housing 41 in FIG. 1) and coaxial coupler units 50 and 50' together form a plug-in r.f. amplifier unit for the FIG. 1 splitter-combiner apparatus. By utilizing coaxial coupler units of the kind disclosed herein for such amplifier unit, that unit can easily be repeatedly unplugged from and then plugged back into the apparatus with assurance that good electrical contact will always be made between the coupler units and the wave guides, that no a.c. impedance mismatch will develop, and that the coupler units will remain firmly secured to the amplifier block with there being no disturbance of the electrical connections of such units to such block.

The above described embodiments being exemplary only, it is to be understood that additions thereto, omissions therefrom and modifications thereof can be made without departing from the spirit of the invention. Accordingly, the invention is not to be considered as limited save as is consonant with the recitals of the following claims.

We claim:

1. The improvement in an assemblage comprising: a waveguide structure comprising, first and second vertically spaced horizontal metal walls bounding opposite sides of a wave-propagation chamber providing for horizontal passage between such walls of high frequency electromagnetic energy, such first and second walls having respectively formed therein relatively large and small vertical coaxial bores of which the large bore passes through said first wall to said space, and the small bore extends from such space at least partly through said second wall; and a coaxial coupler unit for such energy comprising: a tubular outer conductor having an axis and a front end and having a forward portion which extends axially rearward from the front end of such outer conductor, and an axially elongated inner conductor passing in spaced coaxial relation forwardly through said outer conductor and having, in its length, central and forward sections which are, respectively, disposed within said outer conductor and in front of such outer conductor to provide by the latter section a pin projecting axially outward and forward from the front end of said outer conductor, said pin having a forward portion which extends axially rearward from the front end of said pin, said coaxial unit being vertically aligned with the common axis of said coaxial bores and having a lower part inserted in such bores so that at least respective parts of said forward portion of said outer conductor and said pin are respectively received in said large and small bores in, respectively, said first and second metal walls to make electric contacts with metallic surface regions of such two walls extending around said bores at the sides thereof; and said improvement comprising the features that the surface of said first wall on the interior wall surface of said large bore and said forward portion of said outer conductor have a region of mutual contact angularly extending all around such portion and axially disposed adjacent to the opening of said large bore into said chamber, said first wall exerting radially inward force on such forward portion to produce therebetween a pressure contact distributed around such region, the axial extent of such region of pressure contact being substantially less than a minority of the distance over which said outer conductor and the interior wall of said large bore are axially coextensive, and that the part of said outer conductor within said large bore and to the rear of said mutual contact region has over its length a largest outer diameter less by at least a clearance than the smallest inner diameter over said length of said large bore.

2. The improvement according to claim 1 in which said forward portion of said outer conductor comprises a plurality of resilient fingers formed by and between a plurality of angularly spaced radial slots extending axially in such portion from free ends of said fingers at the front end of such portion to rear terminations of such slots marking the rear end of such portion, and in which such region of mutual contact between said first wall and said forward portion occurs between said regions of the interior wall of said large bore and said ends of said fingers, said resilient fingers being radially inwardly deflected by contact with said regions from resiliently unstressed positions of said fingers.

3. The improvement according to claim 2 in which the part of said outer conductor received in said large bore comprises said fingers and a further length of said outer conductor, and in which said region of mutual contact has an axial extent which is substantially less than a minority of the axial length of said fingers.

4. The improvement according to claim 2 in which said fingers at their ends are radially enlarged to define an annular slotted ridge extending at said finger ends around said forward portion of said outer conductor, and in which said annular ridge cooperates with said first wall to provide said region of mutual contact.

5. The improvement according to claim 4 in which said ridge is provided by a bead formed at the front of such forward portion.

6. The improvement according to claim 1 in which said region of mutual contact of said first wall and said forward portion of said outer conductor is essentially a region of line contact therebetween.

* * * * *